US006857585B2

(12) United States Patent
Winner

(10) Patent No.: US 6,857,585 B2
(45) Date of Patent: Feb. 22, 2005

(54) FUEL-INJECTOR VALVE

(75) Inventor: Hermann Winner, Karlsruhe (DE)

(73) Assignee: Robert Bosch GmbH, Stuttgart (DE)

( * ) Notice: Subject to any disclaimer, the term of this patent is extended or adjusted under 35 U.S.C. 154(b) by 155 days.

(21) Appl. No.: 10/204,613

(22) PCT Filed: Dec. 15, 2001

(86) PCT No.: PCT/DE01/04747

§ 371 (c)(1),
(2), (4) Date: Mar. 24, 2003

(87) PCT Pub. No.: WO02/50426

PCT Pub. Date: Jun. 27, 2002

(65) Prior Publication Data

US 2003/0155439 A1 Aug. 21, 2003

(30) Foreign Application Priority Data

Dec. 19, 2000 (DE) ..... 100 63 260

(51) Int. Cl.[7] ..... F02M 59/00; F02M 39/00; B05B 1/30

(52) U.S. Cl. ..... 239/533.2; 239/533.3; 239/533.9; 239/533.12; 239/585.1; 239/585.5; 239/88; 239/125

(58) Field of Search ..... 239/533.2, 533.3, 239/533.8, 533.9, 533.12, 533.14, 463, 585.1–585.5, 88–93, 490, 494; 251/129.5, 129.21

(56) References Cited

U.S. PATENT DOCUMENTS 4,321,900 A * 3/1982 Takeda ..... 123/339.17
5,299,919 A * 4/1994 Paul et al. ..... 417/387
5,392,994 A * 2/1995 Zizelman et al. ..... 239/533.9

FOREIGN PATENT DOCUMENTS

DE 197 36 682 2/1999
DE 197 36 684 2/1999
DE 199 15 210 10/2000

* cited by examiner

*Primary Examiner*—Davis Hwu
(74) *Attorney, Agent, or Firm*—Kenyon & Kenyon

(57) ABSTRACT

A fuel injector is described, particularly for fuel injector systems of internal combustion engines, including an actuator, a valve needle actuatable by the actuator for actuation of a valve-closure member, which together with a valve-seat surface forms a sealing seat, and a swirl device, having at least one swirl channel through which fuel flows having a tangential component regarding a longitudinal axis of the fuel injector. The axial position of a bypass disk, which is mechanically linked to a valve needle, determines a cross section of at least one bypass channel, which bypasses the at least one swirl channel without a tangential component.

9 Claims, 2 Drawing Sheets

FUEL-INJECTOR VALVE

FIELD OF THE INVENTION

The present invention relates to a fuel injector.

BACKGROUND INFORMATION

A fuel injector for direct injection of fuel into the combustion chamber of a mixture-compressing, spark-ignited internal combustion engine which on the downstream end of the fuel injector has a guide and seat area which is formed from three disk-shaped elements is known from German Published Patent Application No. 197 36 682. A swirl element is embedded between a guide element and a valve seat element. The guide element guides an axially movable valve needle penetrating through it, while a valve closing section of the valve needle cooperates with a valve-seat surface of the valve seat element. The swirl element has an inner opening area containing a plurality of swirl channels which are not connected to the outer periphery of the swirl element. The entire opening area extends fully over the axial thickness of the swirl element.

A particular disadvantage of the fuel injector known from the aforementioned document is the fixedly set swirl angle which cannot be adjusted to the different operating conditions of an internal combustion engine, such as partial load and full load operation. As a result, cone opening angle a of the injected mixture cloud also cannot be adjusted to the different operating conditions, which in turn results in inhomogeneities during combustion, increased fuel consumption, as well as increased exhaust gas emission.

SUMMARY OF THE INVENTION

The fuel injector according to the present invention has the advantage over the related art that the swirl is adjustable as a function of the operating state of the fuel injector, whereby a jet pattern may be produced which is adapted to the operating state of the fuel injector, resulting in an optimization of the mixture formation and the combustion process.

The simple design of the swirl producing components is particularly advantageous over the conventional swirl preparation, because they are extended by an easily manufacturable bypass disk which is connectable to the valve needle.

The possibility of combining the measures according to the present invention with fuel injectors having multi-stage lifts and of allocating different swirl intensities to the different lift positions is particularly advantageous.

The implementation of the measures according to the present invention is also advantageous in a fuel injector having continuous lift, because the desired modeling of the mixture cloud may be achieved in a simple manner using suitable geometry of the swirl channels.

It is also advantageous to design a swirl chamber in which the fuel components streaming through the swirl channels may be mixed with those coming from the bypass channel, thereby influencing the mixture cloud according to the requirements of the instantaneous operating condition.

The design of a catch, as well as the separation of the bypass disk from the valve needle, represent a particular advantage, since the opening operation of the fuel injector is not influenced by the bypass disk being raised while the valve needle initially performs a partial lift until the catch strikes the bypass disk.

DETAILED DESCRIPTION

Figure 1:
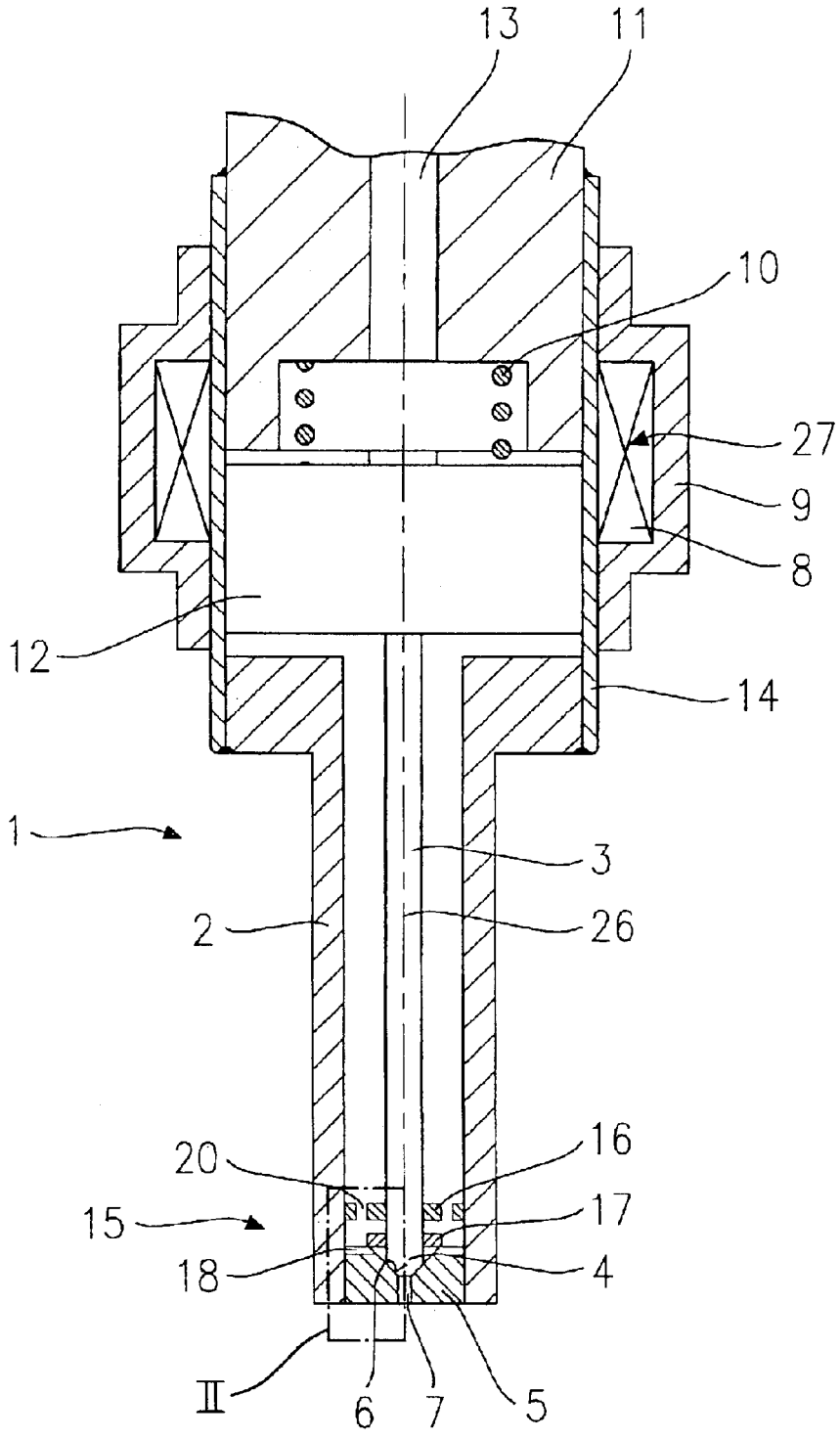
FIG. 1 shows a partial axial section through a first exemplary embodiment of a fuel injector according to the present invention.

A first exemplary embodiment of a fuel injector 1 designed according to the present invention illustrated in FIG. 1 is used in particular for direct injection of fuel into the combustion chamber of a spark-ignited, mixture-compressing internal combustion engine.

Fuel injector 1 includes a solenoid 8 used as actuator 27 and is encapsulated in a coil housing 9, a tubular internal pole 11 and an external pole 14 in the form of a sleeve, which is welded to nozzle body 2. An armature 12 is mechanically linked to valve needle 3 which is configured as valve-closure member 4 in the spray-discharge direction. Valve-closure member 4 cooperates with valve-seat surface 6, which is formed on a valve seat body 5, to form a sealing seat. This exemplary embodiment is an inwardly opening fuel injector 1. At least one spray-discharge orifice 7 is introduced in valve seat body 5.

A swirl device 15, which includes a guide disk 16, a bypass disk 17 and swirl channels 18, is provided on the upstream side of the scaling seat. Swirl device 15 is explained in greater detail in the description of FIGS. 2A and 2B.

In the idle state of fuel injector 1, armature 12 is acted upon by restoring spring 10 against a lift direction in such a way that valve-closure member 4 is held on valve-seat surface 6 in a sealing position. When solenoid 8 is energized, it generates a magnetic field, which moves armature 12 against the elastic force of restoring spring I0 in the lift direction. Armature 12 also entrains valve needle 3 in the lift direction. Valve needle 3 and valve-closure member 4, which have a one-piece design in the exemplary embodiment, are lifted from valve-seat surface 6, whereby bypass disk 17, friction-locked to valve needle 3 via weld 21, also moves in the lift direction, so that bypass channel 19 is opened. Fuel is routed to the at least one spray-discharge orifice 7 through flow-through orifices 20 in guide disk 16, as well as through bypass channel 19 and swirl channels 18 bypassing the sealing seat. A detailed illustration of the procedure is provided by FIGS. 2A and 2B.

When the coil current is switched off, armature 12, after sufficient decay of the magnetic field, drops away from internal pole 11 due to the force of restoring spring 10, whereby valve needle 3, being mechanically linked to armature 12, moves against the lift direction, bypass disk 17 closes bypass channel 19, valve-closure member 4 comes to rest on valve-seat surface 6, and fuel injector 1 is closed.

Figure 2A:
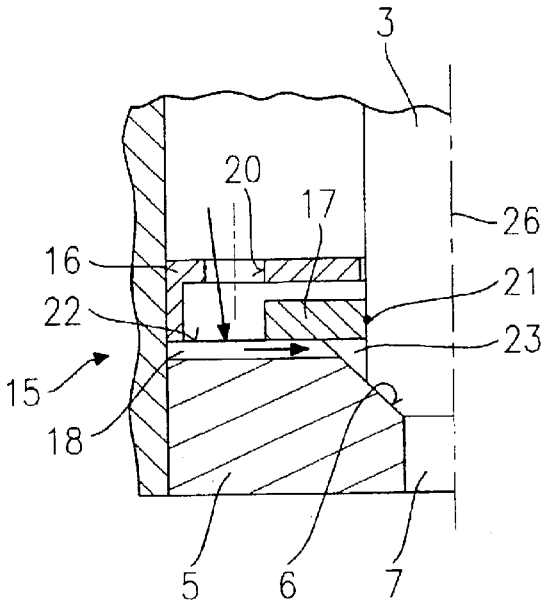
FIG. 2A shows an enlarged detail in area II of FIG. 1, the fuel injector being illustrated in its closed state.

In a partial, schematic axial section FIG. 2A shows fuel injector 1, designed according to the present invention, in its closed state in area II of FIG. 1. The enlarged illustration shows only those components which are relevant to the present invention. The design of the remaining components may be identical with a known fuel injector 1. Elements already described are provided with the same reference symbols in all figures, so that a repeat description is unnecessary.

A mixture-compressing, spark-ignited engine has different requirements with regard to form, stoichiometry, and the penetration capability of the mixture cloud being injected into the combustion chamber in partial load operation as opposed to full load operation. During partial load operation the mixture cloud should have a relatively small opening angle $\alpha$, a great penetration capability, a narrow core area due to the small opening angle $\alpha$, with a richer mixture, and a very lean envelope, while during full load operation a wide opening angle $\alpha$ and with it an almost homogeneous filling of the cylinder with ignitable mixture is present.

The modeling of the parameters of the mixture cloud may be facilitated by influencing the swirl through the above-described measures according to the present invention. If the fuel exits the spray-discharge orifice with little swirl, a mixture cloud having a small opening angle $\alpha$ is injected, while a strong swirl causes the jet to widen more and thus the mixture cloud to have a wide opening angle $\alpha$. The present invention is particularly advantageously applicable in connection with a fuel injector 1 having multi-stage lift or piezoelectric actuators 27.

Swirl device 15 having a bypass channel 19, as indicated in FIG. 1, allows the fuel flow rate to be configured by swirl device 15 as a function of the lift of valve needle 3 of fuel injector 1. In the closed state of fuel injector 1, as it is apparent in FIG. 2A, bypass channel 19 is closed, and thus the fuel may only flow through swirl channels 18.

Figure 2B:
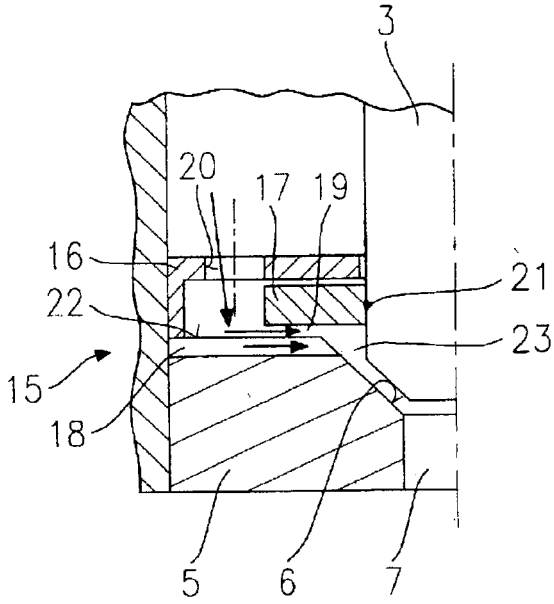
FIG. 2B shows an enlarged detail in area II of FIG. 1, the fuel injector being illustrated in its opened state.

FIG. 2B shows fuel injector 1 according to the present invention in its opened state in the same detail as in FIG. 2A.

If, according to the present exemplary embodiment, actuator 27 designed as a solenoid is actuated, then valve needle 3 is raised in a lift direction against the flow direction of the fuel, whereby bypass disk 17 which is connected to valve needle 3 by weld 21 is also moved in the lift direction. This results in the opening of bypass channel 19, the amount of fuel that flows through depending on the axial position of valve needle 3, i.e., on the distance of bypass disk 17 from an upstream side 22 of swirl channels 18. The fuel flows via flow-through orifices 20 in guide disk 16 to bypass channel 19.

While the flow in swirl channels 18 has a tangential component with regard to a longitudinal axis 26 of fuel injector 1, the flow in bypass channel 19 has no tangential component but only a radial component.

Since the portion of fuel flowing through bypass channel 19 and the portion of fuel flowing through swirl channels 18 are reunited in swirl chamber 23, a mixture cloud develops which contains swirled and unswirled components. This makes it possible, by having a suitable geometry of the swirl-generating components, to generate a mixture cloud which has the characteristics suitable for the operating condition of fuel injector 1.

Figure 3A:
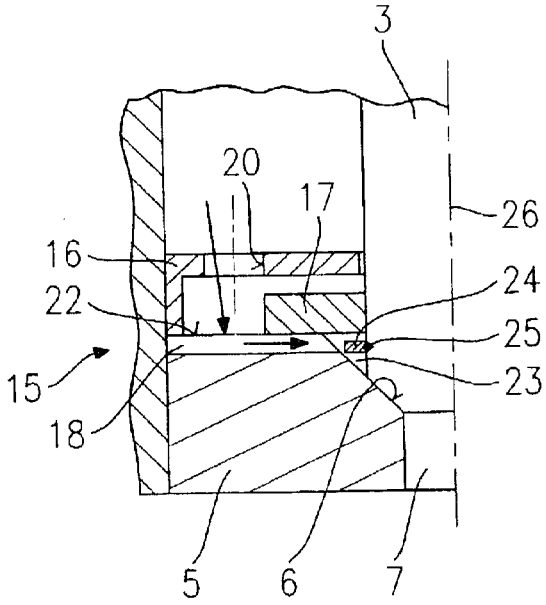
FIG. 3A shows a second exemplary embodiment of a fuel injector according to the present invention as the same detail illustration as in FIG. 2A, the fuel injector being illustrated in its closed state.
Figure 3B:
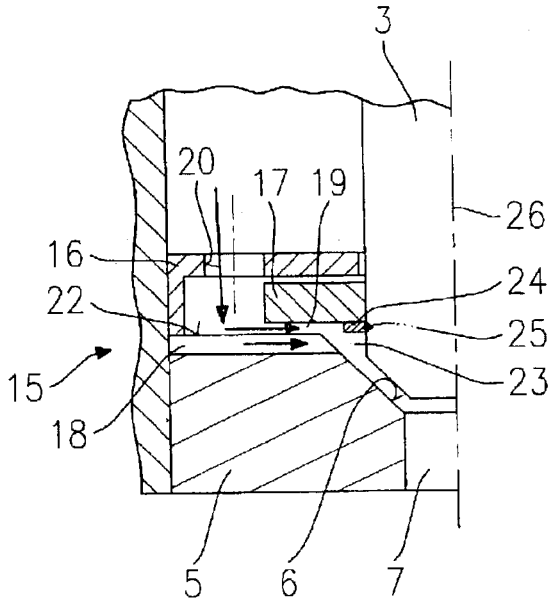
FIG. 3B shows a second exemplary embodiment of a fuel injector according to the present invention in the same way as in FIG. 2B, the fuel injector being in its opened state.

FIGS. 3A and 3B illustrate a second exemplary embodiment of fuel injector 1 according to the present invention using the same view as in FIGS. 2A and 2B.

Bypass disk 17 in the present second exemplary embodiment, in contrast to the first exemplary embodiment illustrated in FIGS. 2A and 2B, is not connected to valve needle 3 by weld 21 or by pressure force, but is instead set on valve needle 3 in an axially movable manner.

Valve needle 3 has a catch 24 which is positively connected to valve needle 3 by weld 25 or by pressure force, etc. This design in particular is advantageously applicable in fuel injectors 1 having two-stage lifts.

If fuel injector 1 is closed, the same conditions as in the first exemplary embodiment of a fuel injector 1 according to the present invention, illustrated in FIG. 2A, prevail. As is apparent in FIG. 3A, bypass channel 19 is closed and fuel flows exclusively through swirl channels 18.

If fuel injector 1 is switched to a first lift position, valve needle 3 performs a partial lift which, for example, accompanies only a slight lift of bypass disk 17 via catch 24 or no lift at all of bypass disk 17; therefore the fuel has a strong tangential swirl component downstream from the sealing seat.

If fuel injector 1 is switched to a second lift position, which corresponds to a greater lift, more fuel flows through wider opened bypass channel 19, because catch 24 has raised bypass disk 17 further. This results in a displacement of the mass ratio between swirled and unswirled fuel, because more fuel flows through bypass channel 19 than through swirl channels 18. Subsequently opening angle a of the injected mixture cloud decreases, while the penetration increases.

The present invention is not limited to the illustrated exemplary embodiments and it is particularly implementable in fuel injectors 1 having multi-stage lifts, in fuel injectors 1 having piezoelectric or magnetostrictive actuators 27, and in any design variant of fuel injectors 1.

What is claimed is:

1. A fuel injector for a fuel injection system of an internal combustion engine, comprising:

an actuator;

a valve-seat surface;

a valve-closure member that cooperates with the valve-seat surface to form a sealing seat;

a valve needle that is actuatable by the actuator for actuating the valve-closure member;

a swirl device including at least one swirl channel through which a fuel flows, the at least one swirl channel including a first tangential component with respect to a longitudinal axis of the fuel injector; and a bypass disk mechanically linked to the valve needle and including an axial position that determines a cross section of at least one bypass channel that bypasses the at least one swirl channel without a second tangential component.

2. The fuel injector as recited in claim 1, wherein:

in a closed position of the fuel injector, the bypass disk rests on an upstream side of the at least one swirl channel.

3. The fuel injector as recited in claim 2, wherein:

in an open position of the fuel injector, the at least one bypass channel is formed between the bypass disk and the at least one swirl channel.

4. The fuel injector as recited in claim 1, further comprising:

a guide disk including at least one flow-through orifice and through which the valve needle penetrates.

5. The fuel injector as recited in claim 1, further comprising:

a valve seat body; and an annular swirl chamber arranged between the valve needle, the bypass disk, and the valve seat body.

6. The fuel injector as recited in claim 5, wherein:

the at least one swirl channel opens into the annular swirl chamber.

7. The fuel injector as recited in claim 5, wherein:

the at least one bypass channel opens into the annular swirl chamber.

8. The fuel injector as recited in claim 1, wherein:

the bypass disk is situated axially displaceably on the valve needle.

9. The fuel injector as recited in claim 8, further comprising: a catch to which the valve needle is friction-locked, wherein:

after the catch performs a partial lift, the catch strikes the bypass disk and thereby raises the bypass disk in a lift direction.

* * * * *

UNITED STATES PATENT AND TRADEMARK OFFICE

CERTIFICATE OF CORRECTION

PATENT NO. : 6,857,585 B2
DATED : February 22, 2005
INVENTOR(S) : Fevzi Yildrim et al.

It is certified that error appears in the above-identified patent and that said Letters Patent is hereby corrected as shown below:

Title page,
Item [75], Inventors, should read -- Fevzi Yildrim, Guenther Hohl, Michael Huebel and Norbert Keim --

Signed and Sealed this

Twenty-fourth Day of May, 2005

JON W. DUDAS
*Director of the United States Patent and Trademark Office*